United States Patent [19]

Kimura

[11] Patent Number: 4,768,887

[45] Date of Patent: Sep. 6, 1988

[54] METHOD FOR DISCHARGING LIQUID STORED IN FLEXIBLE SEALED BAG AND FLEXIBLE SEALED BAG FOR STORING LIQUID

[75] Inventor: Kinichi Kimura, Tokyo, Japan

[73] Assignees: Yoken Co., Ltd., Tokyo; Kiyoshi Uchida, Osaka, both of Japan

[21] Appl. No.: 45,063

[22] Filed: Apr. 30, 1987

[30] Foreign Application Priority Data

May 8, 1986 [JP] Japan ..... 61-105188

[51] Int. Cl.[4] ..... B65D 33/16

[52] U.S. Cl. ..... 383/71; 383/70; 383/907; 383/74; 229/115

[58] Field of Search ..... 383/70, 71, 74, 68, 383/69, 78, 80, 104, 121, 907; 229/113, 116, 115

[56] References Cited

U.S. PATENT DOCUMENTS

| | | | |
|---|---|---|---|
| 1,253,269 | 1/1918 | Moeller | 383/907 |
| 3,041,801 | 7/1962 | Harrison | 383/70 |
| 3,172,796 | 3/1965 | Gülker | 383/907 |
| 3,379,360 | 4/1968 | Crossley | 229/116 |
| 3,556,390 | 1/1971 | Gould | 383/70 |
| 4,040,562 | 8/1977 | Ward et al. | 383/907 |

FOREIGN PATENT DOCUMENTS

| | | | |
|---|---|---|---|
| 574533 | 3/1958 | Italy | 383/71 |

*Primary Examiner*—Willis Little

*Attorney, Agent, or Firm*—Frishauf, Holtz, Goodman & Woodward

[57] ABSTRACT

A flexible sealed bag for storing a liquid comprises a triangle-shaped flexible bag body which is tapered narrower toward its distal end and stores a liquid therein, and a wire for releasably fastening a portion near the distal end of the body, so as to separate the body into a liquid storing portion in which the liquid is sealed and a distal end portion in which the liquid is absent. An opening is formed in the distal end portion. Thereafter, the wire is removed and the liquid in the bag is discharged through the opening.

9 Claims, 2 Drawing Sheets

METHOD FOR DISCHARGING LIQUID STORED IN FLEXIBLE SEALED BAG AND FLEXIBLE SEALED BAG FOR STORING LIQUID

BACKGROUND OF THE INVENTION

The present invention relates to a method for discharging a liquid stored in a flexible sealed bag and to a flexible sealed bag for storing a liquid.

Ingestible liquids such as juices, edible oils, and the like are often sold in canned or bottled form. However, since canning or bottling these liquids involves high costs, demand has increased for an alternative type of container, such as an inexpensive flexible vinyl bag, in which to seal these liquids when they are to be sold.

However, if a liquid is sealed in a flexible bag, the liquid tends to spurt out of the opening, on account of the pressure exerted by the customer's hands when holding onto and opening the bag, thereby wasting part of the liquid content or contaminating clothes with the spilled liquid. For this reason, it is difficult to seal a liquid in a bag.

SUMMARY OF THE INVENTION

It is an object of the present invention to provide a method for discharging a liquid from a flexible sealed bag without fear of spilling the liquid upon opening the bag, and a flexible sealed bag the design of which enables the object of the present invention to be achieved.

DETAILED DESCRIPTION OF THE PREFERRED EMBODIMENTS

An embodiment of the present invention will now be described, with reference to the accompanying drawings.

Figure 1:
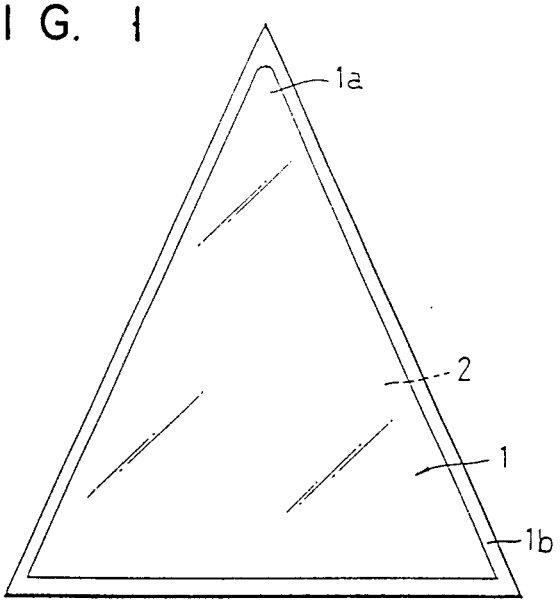
FIG. 1 is a front view showing a sealed bag according to an embodiment of the present invention before a flow-prevention member is attached thereto.

Referring to FIG. 1, reference numeral 1 denotes a bag body in which liquid 2, such as an edible oil, is sealed to a maximum capacity. Bag body 1 is formed such that edge portions 1*b* of a pair of triangular vinyl sheets are heat-fused along their edges to provide a seal, and has high flexibility. Upper portion 1*a* of bag body 1 corresponds to a vertex portion of the triangle, and is tapered narrower toward the distal end.

Figure 2:
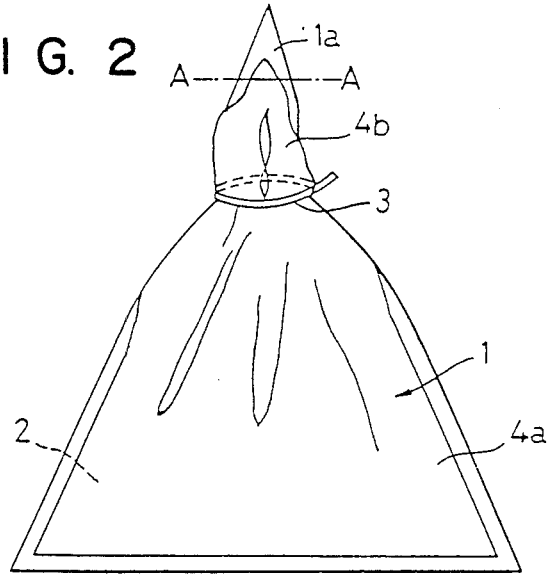
FIG. 2 is a front view showing the sealed bag after the flow-prevention member is attached.

As is shown in FIG. 2, wire 3 is detachably wound around a portion near the distal end of the sealed bag having the above structure, in order to fasten or press this portion. By means of wire 3, bag body 1 is divided into liquid-storing portion 4*a*, in which the entire liquid content is sealed, and distal end portion 4*b*, in which air remaining in bag body 1 is sealed when the liquid is sealed therein. Therefore, wire 3 is wound around a position of bag body 1 at which the liquid and the air remaining in the bag are separated from each other.

In the sealed bag having the above structure, upper portion 1*a* is cut along a portion indicated by line A—A to form an opening and to communicate with the air, as can be seen in FIG. 2. The size of the opening can be freely selected in accordance with the type of liquid contained therein, the application, or the like. The opening can be formed by use of a cutting tool such as a pair of scissors, a cutter, or the like, or else a guide notch can be preformed on the sealed portion. Alternatively, a known easy-open type structure can be adopted in which a detachable tape seal or the like covers a corresponding opening portion.

After the opening is formed as described above, wire 3 is removed from bag body 1, to enable liquid-storing portion 4*a* to communicate with distal end portion 4*b*. Then, the liquid stored therein is discharged through the opening.

If all of the liquid is not being used at that time, then wire 3 is wound around a portion adjacent to the opening, to reseal the bag.

Thus, when using the sealed bag and the liquid-discharging method according to the present invention, even if the bag is being held tightly when it is being opened, since the opening is shut off from liquid 2 by wire 3, the liquid will not spurt out through the opening.

Another embodiment of the sealed bag according to the present invention will now be described, with reference to FIG. 3 and 4.

The same reference numerals in this embodiment denote the same parts as in the above embodiment; thus, a detailed description thereof will be omitted.

Both sides of upper portion 1*a* of bag body 1, shown in FIG. 1, are clamped together by pincher 10, so as to squeeze liquid 2, and the air remaining in this portion, into the lower portion of bag body 1. Pincher 10 preferably has a pair of arms which press together the two entire surfaces of upper portion 1*a*, respectively.

Figure 3:
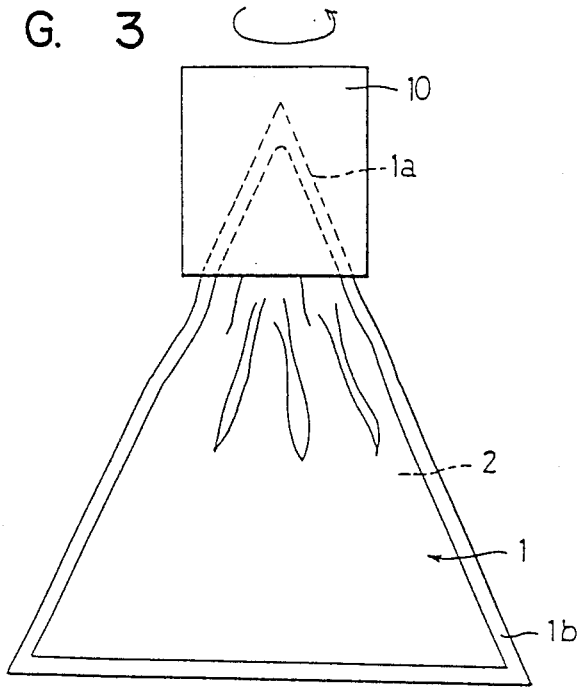
FIGS. 3 and 4 are views for explaining another embodiment of the present invention.
Figure 4:
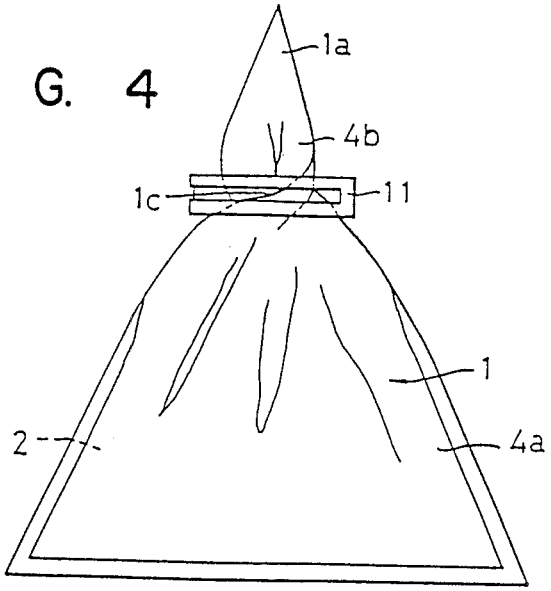

Pincher 10 is rotated through 180 degrees in the direction indicated by the arrow in FIG. 3, while the user holds the lower portion of bag body 1, so that upper portion 1*a* is twisted with respect to the lower portion. As a result, upper portion 1*a* is separated from the lower portion by twisted neck portion 1*c*, as is shown in FIG. 4.

Neck portion 1*c* is clamped by clip 11, so that neck portion remains twisted 180-degrees. In this manner, the interior of bag body 1 is separated into liquid-storing portion 4*a*, in which a liquid is sealed, and distal end poriton 4*b*, where there is no liquid remaining. The operation for opening the sealed bag is performed in the same manner as in the previous embodiment.

In this embodiment, the upper portion is rotated through 180 degrees with respect to the lower portion. However, the lower portion can be rotated with respect to the upper portion, as a matter of course.

In the above embodiments, bag body 1 is a triangular shape. However, bag body 1 can be any other shape as along as it has at least one portion which is tapered narrower toward its distal end. The material of bag body 1 is not limited to a vinyl sheet, but can be any other suitable material such as a synthetic resin sheet of the other sorts, a metal film, or the like, in accordance with the type of liquid sealed therein. In the above embodiments, a wire and a clip have been used as fastening members or flow-prevention members. However, any other suitable means, such as string, tape, or the like can be adopted if it can prevent the inadvertent spilling of liquid out of the opening and can be detached from the bag body.

Using the sealed bag and the method for discharging liquid according to the present invention, a flexible sealed bag is separated in advance, by means of a flow-prevention member, into a portion which is tapered narrower toward the distal end thereof and stores no liquid, and a portion in which a liquid is stored, and an opening for discharging the liquid is formed in the distal end portion. Using this construction, the liquid will not spurt out upon the bag being opened, and there is thus no danger of any of the liquid being wasted through spillage. After the opening has been formed, the flow-prevention member is removed or loosened, to enable the discharging of the liquid through the opening. In this case, since the opening is formed in the distal end portion, while the distal end is directed downward, the liquid can be easily discharged to a predetermined position.

What is claimed is:

1. A method for discharging a liquid from a flexible sealed bag, comprising the steps of:

providing a bag which has its entire periphery sealed;

applying a fastening member at a tapered distal end of the sealed bag to separate the sealed bag into a liquid-storing portion in which the liquid is sealed and a distal end portion from which the liquid is absent;

forming an opening in said distal end portion;

unfastening said fastening member; and discharging the liquid in said sealed bag through said opening of said distal end portion.

2. The method of claim 1, wherein the step of applying the fastening member comprises twisting the liquid-storing portion by 180 degrees relative to the distal end portion, and applying said fastening member at a twisted portion therebetween.

3. The method according to claim 2, wherein said liquid-storing portion and said distal end portion are twisted through 180 degrees while said distal end portion is pressed inward from its two surfaces to squeeze the liquid therein into said liquid storing portion.

4. A flexible sealed bag for storing a liquid, comprising a flexible bag body which is tapered narrower toward its distal end and stores a liquid therein, the entire periphery of said bag being sealed; and a fastening member releasably fastened to a portion near the distal end of said flexible bag body, said bag body having on one side of the fastening member a liquid-storing portion in which the liquid is sealed and, on the other side of the fastening member, a distal end portion from which the liquid is absent;

whereby said member is unfastened after an opening is formed in the distal end of the bag to enable discharge of said liquid through said opening.

5. The flexible sealed bag according to claim 4, wherein said liquid-storing portion and said distal end portion are twisted through 180 degrees relative to each other, and said fastening member is attached to the twisted portion, to maintain this state.

6. The flexible sealed bag according to claim 4, wherein said fastening member includes a wire, clip, string, or tape.

7. A method for manufacturing a sealed flexible bag containing a liquid, comprising the steps of:

introducing liquid into a bag;

sealing the entire periphery of said bag; and applying a fastening member at a tapered distal end of the sealed bag to separate the sealed bag into a liquid-storing portion, in which the liquid is sealed, between the fastening member and a bottom of the sealed bag and a distal end portion, from which said liquid is absent, between the fastening member and a distal end of the bag;

whereby said member is unfastened after an opening is formed in the distal end of the bag to enable discharge of said liquid through said opening.

8. The method of claim 7, wherein the step of applying the fastening member comprises twisting the liquid-storing portion by 180 degrees relative to the distal end portion, and applying said fastening member at a twisted portion therebetween.

9. The method according to claim 8, wherein said liquid-storing portion and said distal end portion are twisted through 180 degrees while said distal end portion is pressed inward from its two surfaces to squeeze the liquid thereinto into said liquid storing portion.

* * * * *